US006547478B1

(12) United States Patent
Lin

(10) Patent No.: US 6,547,478 B1
(45) Date of Patent: Apr. 15, 2003

(54) COUPLING PLATE FRAME

(76) Inventor: Chin-Chih Lin, 3F, No. 128, Cha-Zhuang 1st Street, Kuei Shan, Taoyuan Hsien (TW)

( * ) Notice: Subject to any disclaimer, the term of this patent is extended or adjusted under 35 U.S.C. 154(b) by 0 days.

(21) Appl. No.: 09/604,778

(22) Filed: Jun. 28, 2000

(51) Int. Cl.[7] ..... F16M 11/00; A47G 29/02

(52) U.S. Cl. ..... 403/339; 248/200; 248/235; 248/250; 403/186

(58) Field of Search ..... 248/247, 248, 248/250, 235, 200, 238; 403/205, 403, 231, 237, 230, 339, 389, 186

(56) References Cited

U.S. PATENT DOCUMENTS 678,112 A * 7/1901 Callender
2,477,771 A * 8/1949 Sanford
2,594,656 A * 4/1952 Junkunc
3,606,229 A * 9/1971 Wall
3,829,599 A * 8/1974 Fujioka ..... 248/27.1
3,916,477 A * 11/1975 Baker, Sr.
4,460,094 A * 7/1984 Schoen
5,511,750 A * 4/1996 Evenson ..... 248/200
5,577,695 A * 11/1996 Ruckwardt
6,223,396 B1 * 5/2001 Wartenbergh ..... 16/430
6,289,618 B1 * 9/2001 Kump et al.

* cited by examiner

*Primary Examiner*—Lynne H. Browne
*Assistant Examiner*—Ernesto Garcia
(74) *Attorney, Agent, or Firm*—Troxell Law Office PLLC

(57) ABSTRACT

A coupling plate frame is integrally made of hardened high molecular material and comprises a top plate section a vertical plate section, a bottom plate section, and two flap plates. The top plate section has an engaging hole thereon. The vertical plate section is integrally associated with the top plate with a width gradually reduced from a top to a bottom thereof, and has an engaging hole near the bottom thereof. The bottom plate section is attached integrally to the vertical plate section with extending outward and opposite to the top plate section from the vertical section plate. Each of the flap plates is integrally attached to the top plate section, the vertical plate section, and the bottom plate section, respectively. Each flap plate is slant at the top plate section and extends downward along the vertical plate, and the width between the flap plates is gradually smaller from a top thereof to a bottom thereof. Two of the coupling plates can be lapped to each other without occupying extra space.

2 Claims, 3 Drawing Sheets

COUPLING PLATE FRAME

BACKGROUND OF THE INVENTION

1. Field of the Invention

The present invention relates to a coupling plate frame, and particularly to a plate frame, which has a compact size and provides an intensified strength.

2. Description of Related Art

It is known that a coupling plate frame is frequently used for joining two articles or work pieces. The basic principle of the coupling frame plate resides in that the coupling plate frame is provided with two ends to join a respective article or respective work piece. Hence, both of the articles or the work pieces can be associated with each other firmly.

A coupling plate frame as shown in FIG. 1 is a very simple and popular one to be used for a connection of arranging multiple plate frames vertically. The plate frame in FIG. 1 is an integral piece of steel plate with two horizontal sections and a vertical section. The horizontal sections are provided with engaging holes so as to engage with work pieces or articles by way of screws. Of course, the vertical section may be made inclined such that the cross section of the coupling plate frame is a letter "Z". Basically, the inclined section has an equivalent effect as the vertical one.

The above said coupling plate frame has a uniform thickness and the strength thereof is insufficient such that it easily become bent and deformed after using a long period of time. In the mean time, the outline of the plate frame is a bored fundamental design such that the appearance of the plate frame looks rough without coordination.

However, for a manufacturer, a salesman, and a consumer, a completely assembled article or work piece with a large size may result in an inconvenient handling volume and a much higher cost in delivery, inventory, marketing, and landing. Therefore, a assembled product such as cabinet, decorative light, or computer periphery (support frame of keyboard, . . . ) is DIY type, that is, all parts of the product are detached to minimize the packed volume before delivery and assembled after being received by a consumer. By the same token, it is worth to consider a minimized volume of a packed coupling plate frame.

SUMMARY OF THE INVENTION

An object of the present invention is to provide a coupling plate frame, which has sufficient strength to prevent from being bent and deformed after using a long period of time.

Another object of the present invention is to provide a coupling plate frame, which is possible to be lapped to another coupling plate frame in a way of saving space for easing delivery, inventory, and landing.

A further object of the present invention is to provide a coupling plate frame, which is possible to lower the cost spent in delivery, inventory, and landing.

A further object of the present invention is to provide a coupling plate frame, which has a smooth and gentle appearance.

BRIEF DESCRIPTION OF THE DRAWINGS

The present invention can be more fully understood by referring to the following description and accompanying drawing, in which:

FIG. 3 is another perspective view of the coupling plate frame shown in FIG. 2; and.

DETAILED DESCRIPTION OF THE PREFERRED EMBODIMENTS

Basically, the coupling plate frame according to the present invention is made of hardened high molecular material and integrally formed by way of injection.

Figure 1:
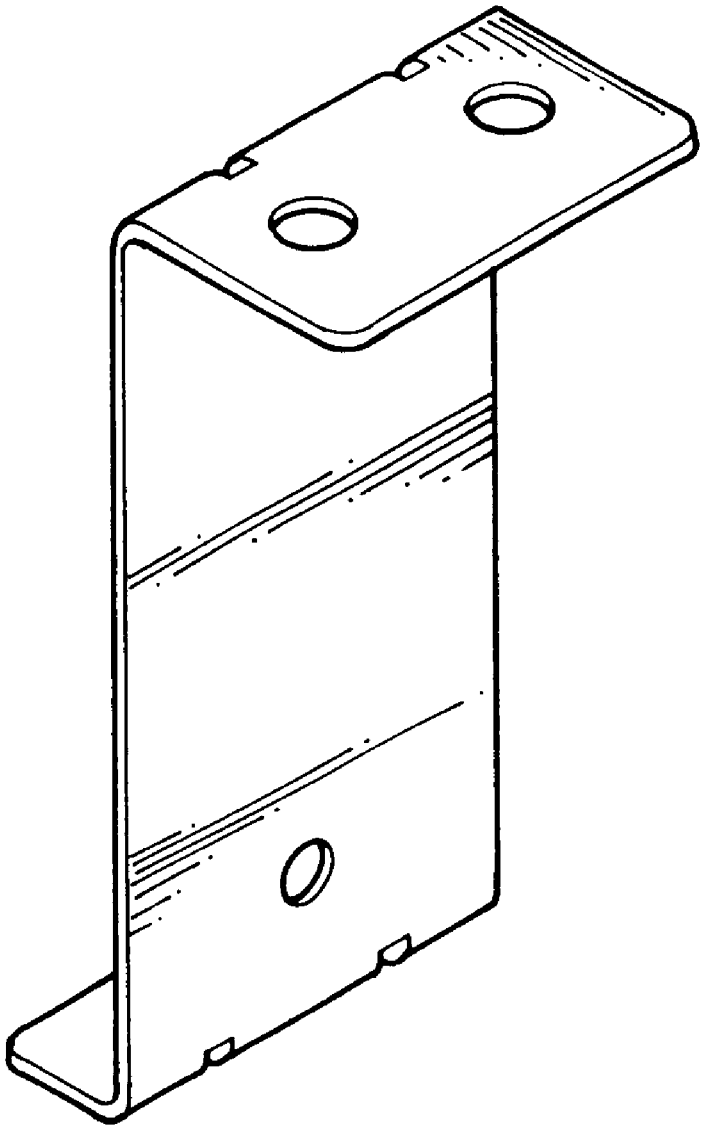
(PRIOR ART) FIG. 1
FIG. 1 is a perspective view of an above said prior art of coupling plate frame.
Figure 3:
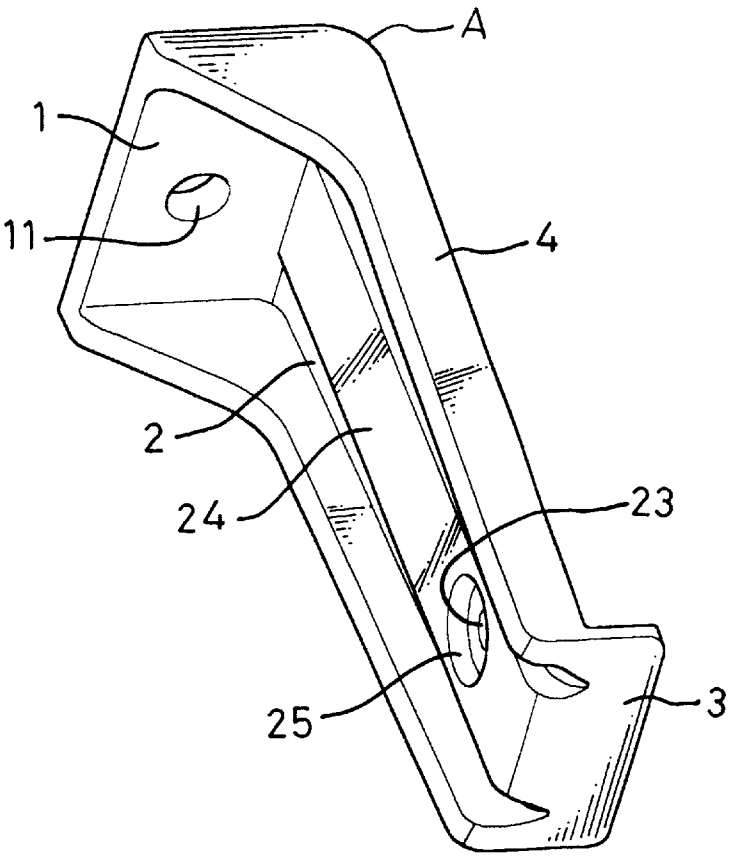
Figure 2:
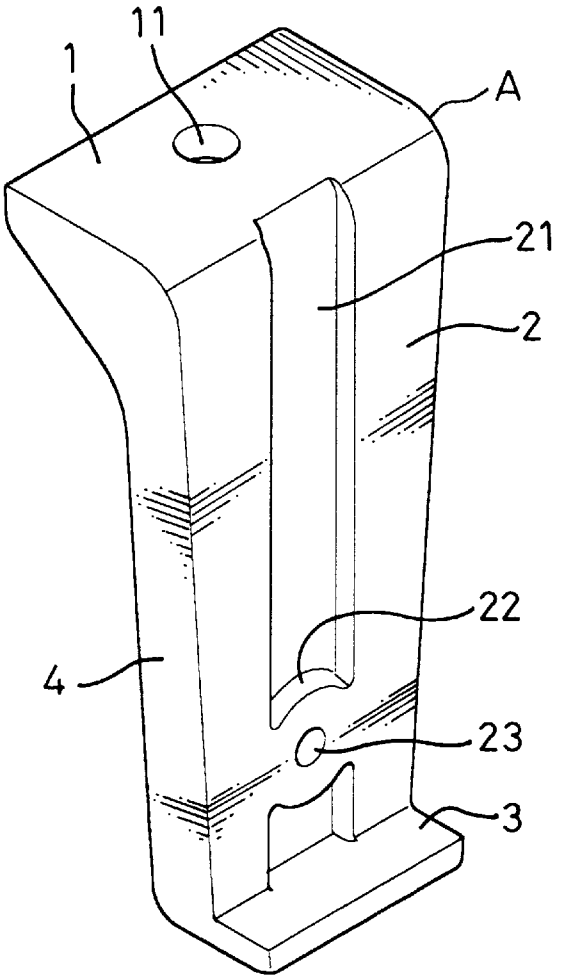
FIG. 2 is a perspective view of a coupling plate frame according to the present invention.

Referring to FIGS. 2 and 3, the coupling plate frame in a preferred embodiment according to the present invention comprises a top or first plate section 1, a vertical plate section 2, a bottom or second plate section 3, and two flap parts 4 at both lateral sides thereof.

The top plate section 1 is provided with flat plane of equal thickness and has an upper engaging hole 11 thereon provided to engage with a joined article. In order to allow the plate frame having a smooth appearance, edges thereof are possible to provide round comers. The machining technique for the round corners is a known art so that no detail will be described further.

The vertical plate section 2 is perpendicular to the top plate section 1 and the intersection A may be designed as a circular arc to make the outline thereof smooth and gentle. In order to intensify the strength thereof, an elongated recession 21 is provided at the middle part on one facial side. A circular ring 22 is abrupt from the recession 21 near the bottom plate 3 to flush with the rest part of the facial side. A central hole 23 in the circular ring 22 to be passed through by a screw for fastening. An elongated rib 24 is provided on the other facial side at the middle part thereof corresponding to the recession 21 and a counter bore 25 is provided corresponding to the circular ring 22. The vertical plate section 2 has a homogeneous thickness and a width gradually converging from the upper part to the lower part thereof.

The bottom plate section 3 is flat plane for supporting a joined article beneath. In order to be available for lapping to each other, the width of the bottom plate section 3 is smaller than the distance between the flap plates 4 at top section 1. It can be seen in the figures that the top section 1 and the bottom plate section 3 oppositely extends outward with respect to the vertical plate section 2. The intersection of the bottom plate section 3 and the vertical plate section 2 may be provided with round corner.

The flap plates 4 are oppositely provided on the top plate section 1 and the vertical plate section 2 and a slant part is provided at the junction of each flap plate 4 and the top plate section 1 respectively. A flat part extends downward along the vertical plate section 2 from the slant part and terminates at the reverse side of the bottom plate section 3. The flap plates 4 are perpendicular to the vertical plate section 2 respectively so as to reinforce the lateral strength of the plate frame.

Referring to FIG. 2 again, the coupling plate frame of the present invention is symmetrically designed. At the right side of the plate frame, the top plate section 1 at the engaging hole thereof joins the lower side of an article thereupon and the bottom plate section 3 can support another article, which is fastened by way of the engaging hole 23. At left side of the plate frame, another plate frame is inversely associated with to constitute upper and lower layers of connection for joined articles. In addition, the flap plates 4 at both lateral sides and the elongated rib 24 thereof intensify the strength to allow the plate frame without being deformed easily. Therefore, an excellent and durable junction can be reached accordingly. Of course, the coupling plate frame can be set up optionally in a reversed direction, and it is a choice in practice so no detail will be further described.

Figure 4:
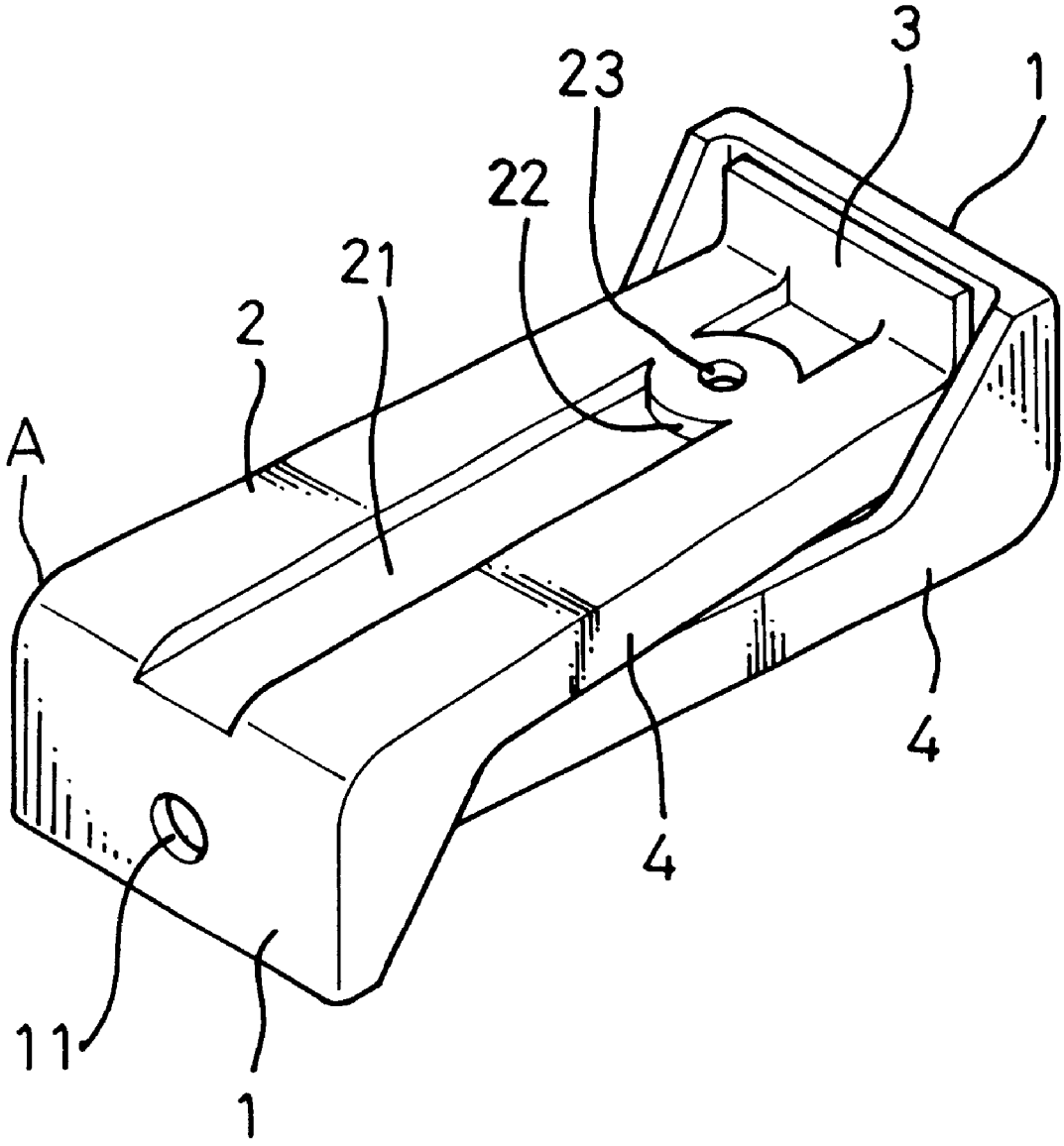
FIG. 4 is a perspective view illustrating two coupling plate frames lapping to each other.

Referring to FIG. 4, the coupling plate frame according to the present invention is oppositely lapped with another one coupling plate frame. The bottom plate section 3 is received between flap plates 4 at the top plate section 1. There is no extra space occupied such that it is helpful for reducing cost.

It is appreciated that the coupling plate frame according to the present invention can obtain a firm connection and support and it is not possible for the prior art to reach.

While the invention has been described with reference to a preferred embodiment thereof, it is to be understood that modifications or variations may be easily made without departing from the spirit of this invention, which is defined by the appended claims.

What is claimed is:

1. A coupling plate frame integrally made of hardened high molecular material, comprising:

a first plate section with an engaging hole;

a second plate section, spaced from the first plate section;

a vertical plate section formed integral with, and connecting the first and second plate sections, the vertical plate section having a width diminishing in a direction from the first plate section toward the second plate section, the vertical plate section having an engaging hole near the second plate and a first face with an elongated central recess extending from the first plate section to the second plate section and a second, opposite face with a rib corresponding in location to the elongated recess; and a flap plate extending from each of two opposite lateral sides of the first plate section, the vertical plate section, and the second plate section, respectively, a distance between the flap plates being greater than a width of the second plate section;

whereby, the coupling plate can be lapped to another coupling plate.

2. The coupling frame according to claim 1, further comprising an arcuate connection at each of an intersection of the first plate section and the vertical plate section, and an intersection of vertical plate section and the second plate section.

* * * * *